US006968992B2

(12) United States Patent
Schuster

(10) Patent No.: US 6,968,992 B2
(45) Date of Patent: Nov. 29, 2005

(54) HANDLE AND TOP HANDLE REINFORCEMENT FOR A PAPERBOARD CARTON

(75) Inventor: Richard L. Schuster, West Monroe, LA (US)

(73) Assignee: Graphic Packaging International, Inc., Marietta, GA (US)

( * ) Notice: Subject to any disclaimer, the term of this patent is extended or adjusted under 35 U.S.C. 154(b) by 44 days.

(21) Appl. No.: 10/693,210

(22) Filed: Oct. 24, 2003

(65) Prior Publication Data

US 2005/0087592 A1 Apr. 28, 2005

(51) Int. Cl.[7] ..... B65D 5/468
(52) U.S. Cl. ..... 229/117.16; 229/199; 229/242
(58) Field of Search ..... 229/117.16, 199, 229/242; 206/427

(56) References Cited

U.S. PATENT DOCUMENTS 3,825,170 A * 7/1974 Aust et al. ..... 229/117.16
4,318,474 A * 3/1982 Hasegawa ..... 229/117.16
4,757,938 A * 7/1988 Collins ..... 229/199
5,072,876 A * 12/1991 Wilson ..... 206/427
5,350,109 A * 9/1994 Brown et al. ..... 229/117.16
5,873,516 A * 2/1999 Boggs ..... 229/117.13
6,170,741 B1 * 1/2001 Skolik et al. ..... 229/199
6,471,120 B1 * 10/2002 Vogel ..... 229/117.16
6,631,803 B2 * 10/2003 Rhodes et al. ..... 206/427

* cited by examiner

*Primary Examiner*—Gary E. Elkins
(74) *Attorney, Agent, or Firm*—Womble Carlyle Sandridge & Rice, PLLC

(57) ABSTRACT

A fully enclosed carton for carrying heavy loads with a reinforcement insert for the handle apertures located in the top end flaps of the carton. The paperboard reinforcing insert may be extended as a bridge across the top panel of the carton to prevent tearing of the handle apertures in the top end flaps and also tearing in the top panel of the carton when carrying a heavy load. The carton may have one or more dispensers in the top panel which may extend into an adjoining side panel. Multiple tear lines may be formed for the dispenser flap in the insert that extends across the top panel to permit easy access to the containers, such as bottles, in the carton.

The paperboard reinforcing insert may have a larger aperture than the handle aperture in each top end flap to adjust for any imprecision in the alignment of the paperboard insert in forming the carton sleeve from the paperboard blank. When the paperboard insert extends across the top panel and one or more dispensers are formed in the top panel, multiple tear lines may be used to form the flaps in the insert to compensate for any imprecision in the insertion of the insert that extends across the top panel into the carton sleeve when it is being formed.

35 Claims, 7 Drawing Sheets

HANDLE AND TOP HANDLE REINFORCEMENT FOR A PAPERBOARD CARTON

FIELD OF THE INVENTION

The present invention relates generally to an enclosed paperboard carton which has a carrying handle aperture in each end that is reinforced with a paperboard insert that is capable of carrying a heavy load of filled containers, such as bottles, without the carrying handle aperture tearing. The paperboard insert may be extended as a bridge from a carrying handle aperture in one end flap across the top panel to a carrying handle aperture in the other top end flap to ensure that the carrying handle apertures and top panel are not torn during carrying, even if the carton is being carried by a single carrying handle. This carton may have one or more dispensers in the top panel even with the insert bridge extending across the top panel.

BACKGROUND OF THE INVENTION

Fully enclosed paperboard cartons with carrying handles apertures in the top end flaps have been used in the past. These cartons can be filled with cans or bottles and carried by a person whose hands are inserted into both carrying handle apertures or in some cases only into one carrying handle aperture. However, if a load of containers, such as filled bottles, is too heavy, these carrying handle apertures in the paperboard carton tend to tear into the top end flap and top panel resulting in the carton being partly destroyed with some or all of the containers falling out. Consequently, fully enclosed cartons with handles in the top end flaps that are used to carry heavy loads are frequently constructed of corrugated board.

It would be desirable to find a method of reinforcing the carrying handle apertures in the top end flap of paperboard cartons so they could carry a heavy load of filled bottles. It would also be desirable to develop a method of reinforcing the top panel which also has a tendency to tear when the carrying handle aperture in a top end flap tears.

It would be desirable to have a method of reinforcing the top panel of a paperboard carton and still provide one or two dispensers in the top panel for dispensing bottles or other types of containers.

SUMMARY OF THE INVENTION

In one embodiment of this invention, a fully enclosed carton for carrying a heavy load of containers is provided. The carton has a top panel and foldably attached top end flaps with a handle aperture in at least one flap for carrying the carton. A paperboard insert with an aperture which is aligned with a handle aperture in a top end flap is provided for reinforcing the handle aperture in the top end flap. The carton may have side end flaps with apertures that align with the handle aperture in the top end flap. A paperboard insert with a handle aperture could be placed on both of the side end flaps for reinforcing the handle aperture in the adjoining top end flap.

It is preferred that the insert be placed on the top end flap. When the insert is constructed, it is preferred that it have a bigger aperture than the handle aperture in the top end flap to allow for any imprecision in aligning the insert with the top end flap. The carton of this embodiment may have one or more dispenser flaps in the top panel which may extend into the adjoining side panel. The dispenser flaps are formed by tear lines which are torn providing access to the containers in the carton.

When the paperboard insert is attached to the top end flap, preferable by glue, and the ends of the carton are closed there are at least three layers of paperboard to prevent the handle aperture in the top end flap from tearing when carrying a heavy load of containers by a handle aperture in one top end flap or a handle aperture in both top end flaps.

In another embodiment of this invention a fully enclosed carton with handle apertures in the top end flaps is provided for carrying a heavy load of containers, such as a large number of filled bottles. This carton is constructed from a blank similar to the blank for the first embodiment described above. However, the paperboard insert for this carton not only is secured to one top end flap but extends across the top panel as a bridge and is secured to the top end flap on the other end of the carton. An aperture is provided on each end of the insert for alignment with the corresponding handle aperture in the top end flap of this carton. The apertures in the insert may be slightly larger than the handle apertures in the top end flaps to allow for any imprecision in the alignment of the insert into the carton sleeve during its formation. To allow for any imprecision in the alignment of the insert, the distance between the edges of the insert may be slightly less than the width of the top panel.

Because it may be difficult to fold the insert along the fold line between the top end flap and the top panel, apertures may be formed along this fold line in the insert to facilitate folding of the two layers of paperboard.

The carton of this embodiment may have one or more dispenser flaps formed in the top panel by tear lines which may be opened giving the consumer access to the containers in the carton. A finger flap may be formed along one tear line, and in the case of twin dispenser flaps along a common tear line between the flaps to enable the consumer to open one or both dispenser flaps. Corresponding flaps are provided in the insert. A plurality of tear lines may be used to form the flaps in the insert to allow for any imprecision in the alignment of the insert when being placed and secured to the top panel. It is necessary that the corresponding flap in the insert be opened when a dispenser flap in the top panel is opened. Consequently, some of the tear lines in forming the flaps in the insert should be located inside the tear lines forming the dispenser flaps in the top panel. In the case where two dispenser flaps are located in the top panel with a finger flap, a corresponding aperture may be located in the insert so a person's finger can push the finger flap in through the aperture in the insert and grasp both the dispenser flap and corresponding flap in the insert for opening. In the case of twin dispensers in the top panel with a common tear line between the flaps, the corresponding tear line in the insert should have subsidiary tear lines to allow for misalignment of the insert in respect to the top panel. This common tear line is basically perpendicular to the ends of the carton in the case of one type of dispenser that may be utilized with this embodiment. The tear line that forms a flap in the insert which is parallel to the ends of the container may have multiple parallel tear lines with at least one of these tear lines being located inside the parameters of the corresponding dispenser flap in the top panel to enable the dispenser flap and the flap in the insert to be opened together, which is necessary to gain access to the containers in the carton. If all of the tear lines in forming a flap in the insert were located outside of the tear line in forming the corresponding dispenser flap in the top panel, it would be very difficult to open both the dispenser flap and the flap in the insert as the latter flap would be restricted from moving by any adjacent portion of the top panel which is outside the tear line for forming the dispenser flap in the top panel.

The insert for this carton not only provides at least three layers of paperboard to prevent tearing of the handle aperture in the top end flap, but provides a bridge in the form of the portion of the insert that extends across the top panel to prevent tearing of the top panel and end flaps when the carton is carrying a heavy load.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT

The present invention is intended primarily for use with bottles of the types used to contain soft drinks, beer, and the like. The carton of the present invention is especially designed to carry heavy loads of filled bottles by the carrying handle apertures in the top end flaps.

Figure 1:
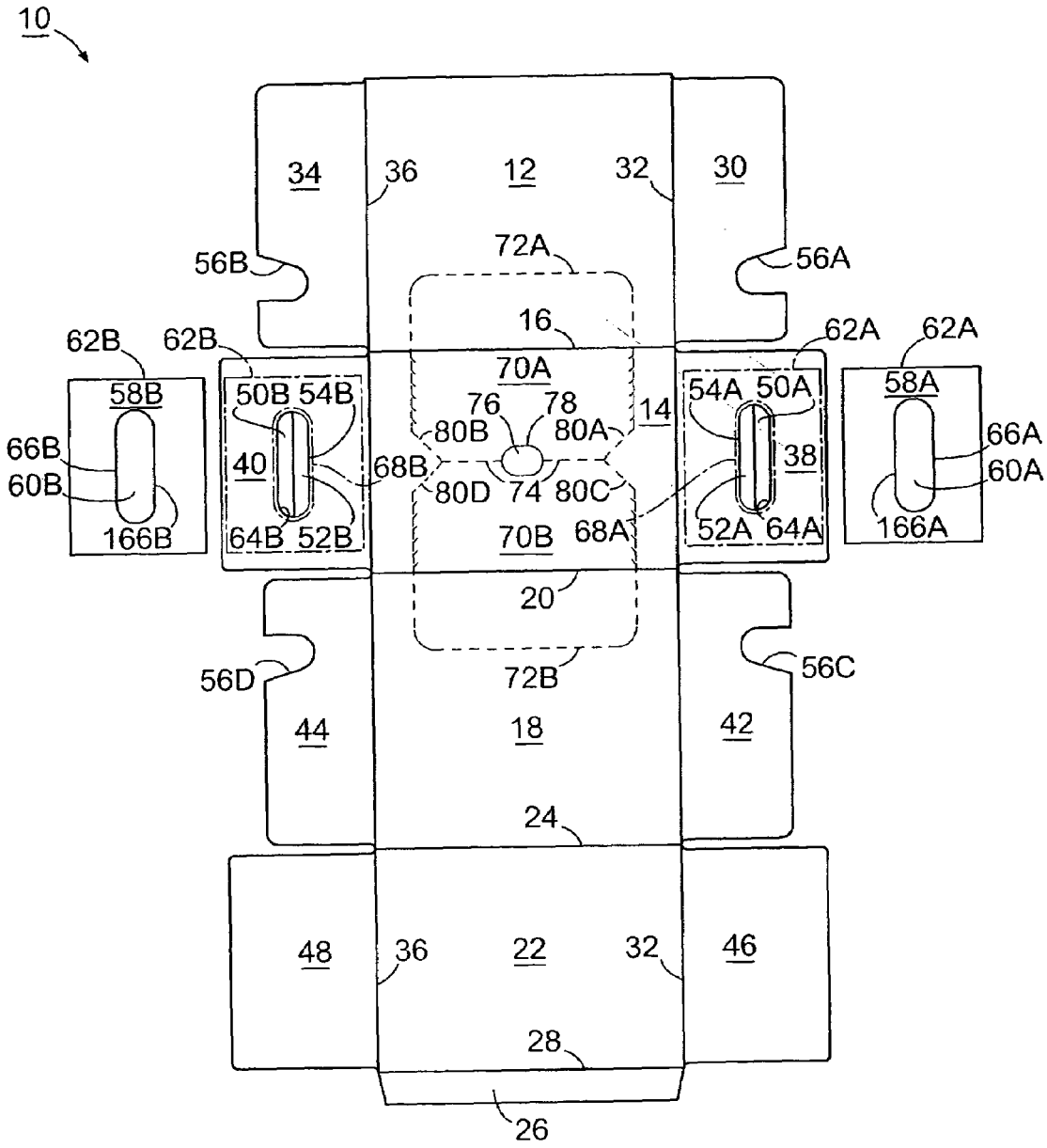
FIG. 1 is a plan view of a blank from which a fully enclosed carton is constructed with carrying handle apertures in the top end flap, and spaced away from the blank are paperboard inserts for reinforcing each aperture according to one embodiment of this invention.

As illustrated in FIG. 1, the blank 10 is formed from a foldable sheet of material, such as paperboard. The blank 10 has a side panel 12 which is connected to a top panel 14 by fold line 16 and in turn connected to side panel 18 by fold line 20, and in turn connected to bottom panel 22 by fold line 24. The bottom panel 22 is connected to glue flap 26 by fold line 28. Side end flaps 30 and 34 are connected to side panel 12 by fold lines 32 and 36, respectively. Top end flaps 38 and 40 are connected to top panel 14 by fold lines 32 and 36. Side end flaps 42 and 44 are connected to side panel 18 by fold lines 32 and 36, respectively. Bottom end flaps 46 and 48 are connected to bottom panel 22 by fold lines 32 and 36, respectively.

Top end flaps 38 and 40 have handle apertures 50A and 50B, respectively. Each handle aperture may have a handle flap 52A and B which is connected to top end flap 38 and 40 by fold lines 54A and B, respectively. Side end flaps 30, 34, 42 and 44 may have apertures 56A–D corresponding to the respective handle aperture 50A and B.

A paperboard insert 58A and B, each with an insert aperture 60A and B, is shown in position prior to placement on the blank 10. Each insert 58A and B has an edge 62A and B which is shown in phantom lines after placement on the respective top end flap 38 and 40.

Handle aperture cut lines 64A and B are shown in the respective top end flap 38 and 40. Cut lines 66A and B are shown in inserts 58A and B. Phantom cut lines 68A and B (i.e. identical to cut lines 66A and B) for the insert apertures are shown when the inserts 58A and B have been placed in proper position on the top end flaps.

The carton made from this blank 10 may have one or more dispensers for allowing the removal of containers, such as bottles, from the carton. Dispenser flaps 70A and B are shown formed by tear lines 72A and B in the top panel 14 and adjoining side panels 12 and 18. A common tear line 74 for both dispenser flaps 70A and B is shown in the top panel 14. A finger flap 76 is formed along this common tear line 74 by tear line 78. Tear lines 72A and B may be connected to common tear line 74 by diagonal tear lines 80A–D.

The blank 10 is generally symmetrical for economy and production. The blank 10 is formed into a carton sleeve by gluing glue flap 26 to side panel 12. In the process of forming this sleeve an inserter mechanism inserts inserts 58A and B into the proper position on top end flaps 38 and 40 and glues them into position. While these inserts 58A and B could be inserted so they are on the outside of the carton, it is preferred for aesthetic reasons that they be inserted on the inside of the carton. It will be noted that insert apertures 60A and B are larger than handle apertures 50A and B as shown by the fact that handle aperture cut lines 64A and B lie inside of phantom cut lines 68A and B for the insert aperture. This difference is designed to allow for any imprecision occurring in the location and gluing of the inserts 58A and B.

This blank 10 when formed into a carton is capable of holding three rows of bottles with four bottles in each row. After the bottles have been loaded into the carton sleeve, the various end flaps on both ends are closed and glued. Using one end of the carton as an example, side end flaps 30 and 42 are folded inwardly and top end flap 38 and bottom end flap 46 are folded and glued to side end flaps 30 and 42. It should be realized that other means of securing the end flaps together, such as stapling and the like may be used.

The carton filled with bottles can be easily carried by a person whose hands are inserted into handle apertures 50A and B and corresponding insert apertures 60A and B and apertures 56A–D so the carton can be easily carried. The inclusion of inserts 58A and B permits this carton loaded with heavy bottles to be easily carried without any tearing occurring along the handle aperture cut lines 64A and B or fold lines 54A and B.

The thickness or caliber of the paperboard insert needed would depend upon the caliber of the paperboard from which the blank is constructed and the weight of the loaded bottles.

This carton can be constructed by providing only a single handle aperture, but it is preferred that there be two handle apertures 50A and B and that both be reinforced by inserts 58A and B. As people sometimes carry these loaded cartons by one hand, the inserts 58A and B may need to be strong enough to reinforce the handle apertures 50A and B so that this can be done without tearing the carton.

Figure 2:
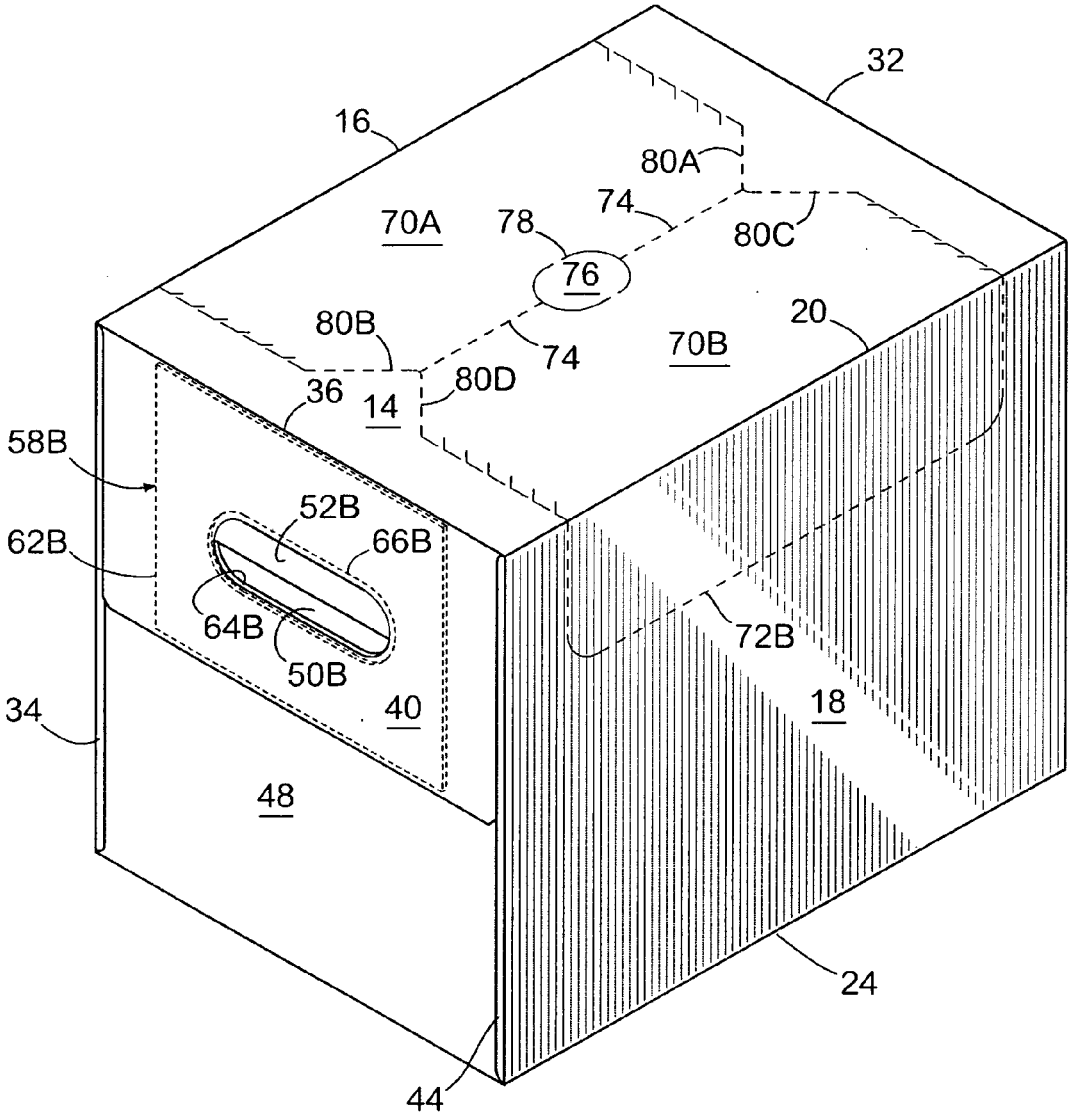
FIG. 2 is a perspective view of the carton made from the blank and inserts of FIG. 1 and loaded with bottles showing the tear lines for the twin dispenser flaps.

This carton may be provided with one or more dispensers for removing the bottles. A fully loaded carton with twin dispensers is illustrated in FIG. 2. Either or both of these dispensers can be opened by a person pushing the finger flap 76 inwardly and opening either or both dispenser flaps 70A and B. Depending on the direction of pull of a person's finger, the tearing occurs along common tear line 74 and tear lines 72A or B.

Figure 3:
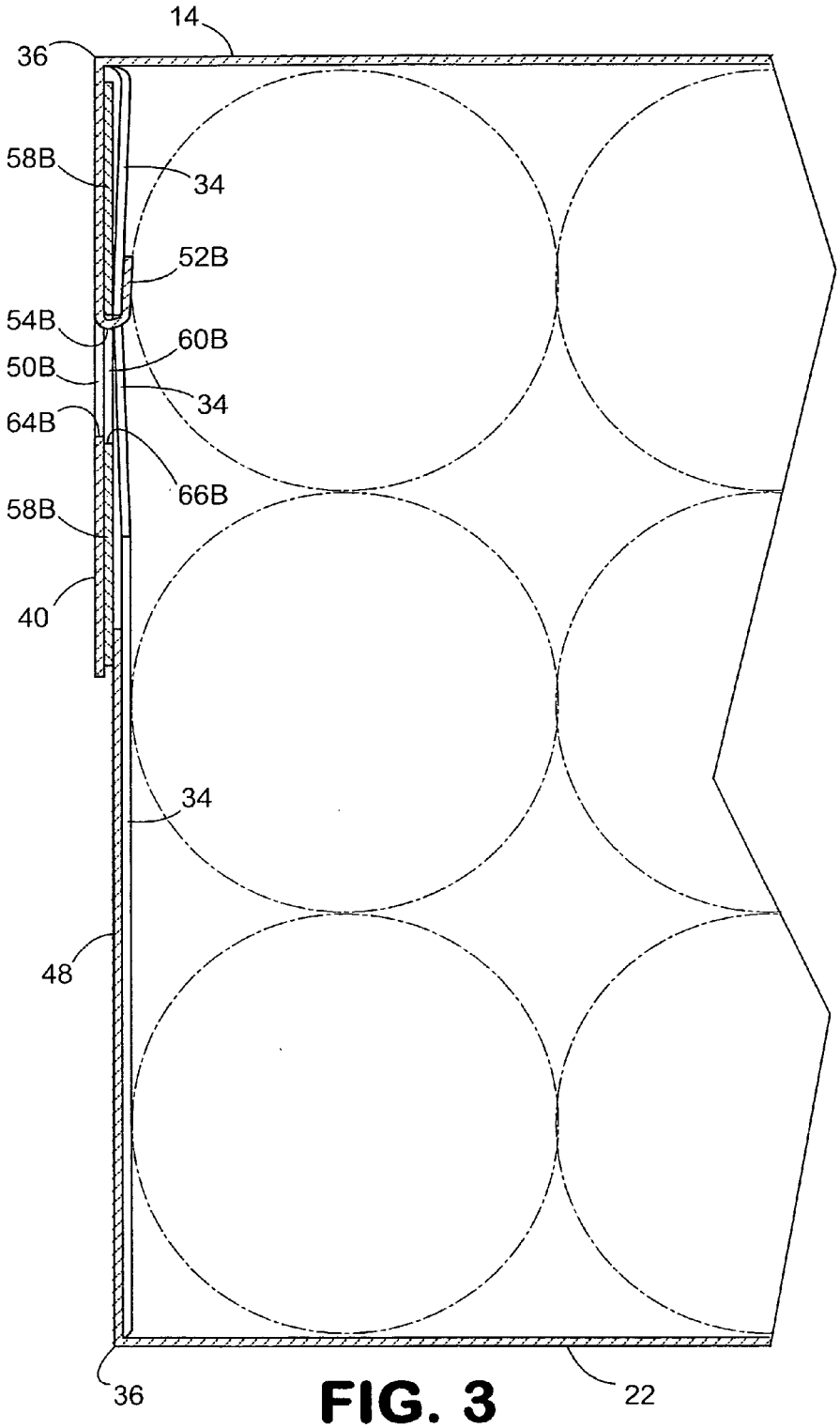
FIG. 3 is a fragmentary longitudinal cross-section of the carton of FIG. 2 showing a top end flap with a carrying handle aperture reinforced by a paperboard insert.

The reinforcement of the handle aperture 50B is illustrated in FIG. 3 which is a fragmentary longitudinal cross-section of one end of the loaded carton shown in FIG. 2 showing the top end flap 40 with insert panel 58B in position and handle flap 52B folded over insert 58B and side end flap 34. Thus, the handle aperture 50B is protected from tearing by four layers of paperboard.

It should be realized that inserts can be designed to be adhered to side end flaps 30, 34, 42, and 44. For ease of construction it is preferred that the inserts 58A and B be located on the top end flaps 38 and 40.

Figure 4:
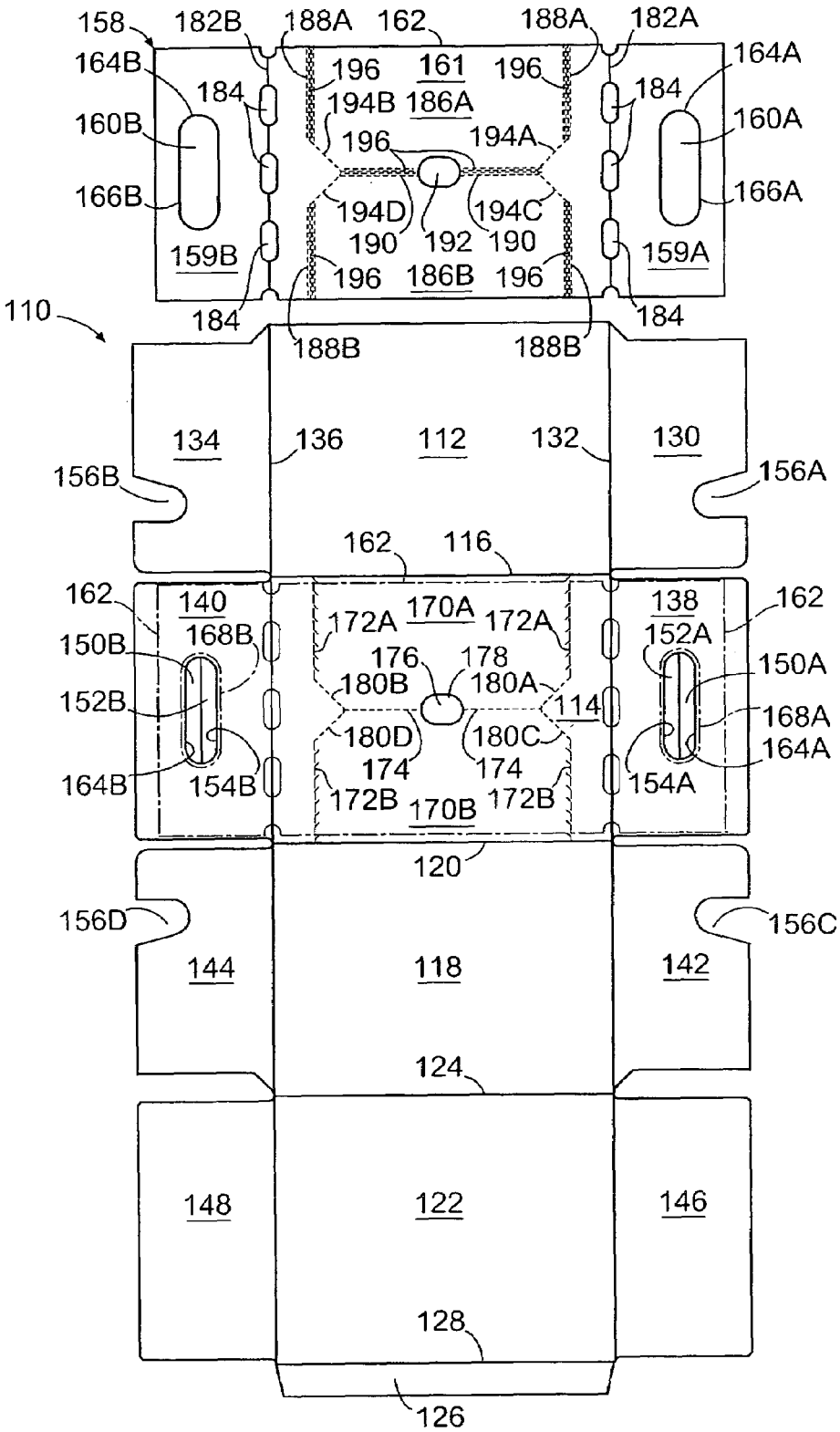
FIG. 4 is a plan view of a blank from which a carton is constructed with carrying handle apertures in the top end flaps, and spaced away from the blank is a paperboard insert for reinforcing the carrying handle apertures and top panel of the carton according to another embodiment of this invention.

Another embodiment of this invention is illustrated in the blank and insert shown in FIG. 4. The blank 110 is formed from a foldable sheet of material, such as paperboard. The blank has a side panel 112 which is connected to top panel 114 by fold line 116 and in turn connected to side panel 118 by fold line 120 and to bottom panel 122 by fold line 124 and to glue flap 126 by fold line 128. Side end flaps 130 and 134 are connected to side panel 112 by fold lines 132 and 136, respectively. Top end flaps 138 and 140 are connected to top panel 114 by fold lines 132 and 136, respectively. Side end flaps 142 and 144 and bottom end flaps 146 and 148 are connected to side panel 118 and bottom panel 122 by fold lines 132 and 136, respectively. Top end flaps 138 and 140 have handle apertures 150A and 150B with handle flaps 152A and 152B which are attached to top end flaps 138 and 140 by fold lines 154A and B.

Side end flaps 130, 134, 142, and 144 have apertures 156A–D corresponding to handle apertures 150A and B.

A paperboard insert 158 illustrated in FIG. 4 is in position for inserting and securing to the blank 110. The insert 158 has insert apertures 160A and B. The insert 158 has an edge 162 that is also shown in a phantom line in its proper location secured to top panel 114 and top end flaps 138 and 140.

The handle apertures 150A and B have cut lines 164A and B defining the apertures. The insert 158 also has cut lines 166A and B, which are shown as phantom cut lines 168A and B when the insert 158 is properly positioned on the blank 110.

The carton formed from this blank may have one or more dispenser flaps which can be opened for dispensing containers, such as bottles, from the carton. In this embodiment, there are two dispenser flaps 170A and B which are defined by tear lines 172A and B and share a common tear line 174.

A finger flap 176 is located along common tear line 174 to aid in opening the twin dispensers flaps 170A and B. The finger flap 176 is defined by tear line 178. Diagonal tear lines 180A–D may be formed between the common tear line 174 and tear lines 172A and B for ease in opening the dispenser flaps.

Because the insert 158 extends all the way across top panel 114 and top end flaps 138 and 140, it is necessary to provide fold lines 182A and B which correspond to fold lines 132 and 136 in the blank 110. These fold lines 182A and B subdivide the insert 158 into side panels 159A and B attached to a central panel 161. Apertures 184 may be provided along fold lines 182A and B to facilitate the folding of the insert 158 when the top end flaps 138 and 140 of the carton are closed.

The insert 158 has flaps 186A and B in the central panel 161 that correspond to dispenser flaps 170A and B in the top panel 114. Like the dispenser flaps 170A and B in the top panel 114, the corresponding flaps 186A and B in the insert 158 are defined by tear lines 188A and B which are joined to common tear line 190. Diagonal tear lines 194A–D may be provided between tear lines 188A and B and common tear line 190. For ease in opening a dispenser flap, such as 170A and the corresponding flap 186A in the insert 158, inside subsidiary tear lines 196 may be provided at various locations along tear lines 188A and B and common tear line 190. The insert 158 may have a finger aperture 192 along common tear line 190 which corresponds to finger flap 176 in the top panel 114.

As in the case of the blank shown in FIG. 1, the blank 110 as shown in FIG. 4 may be formed into a carton sleeve by gluing glue flap 126 to side panel 112. In the process of forming the carton sleeve the insert 158 may be put in proper position adjacent to top panel 114 and top end flaps 138 and 140. While this insert 158 could be placed on the outside of the carton, it is preferred for aesthetic reasons to place it on the inside of the carton. Because the insert is inserted into the carton at high speed by an insertion mechanism, there may be some imprecision in the alignment of insert 158 with top panel 114 and top end flaps 138 and 140. Thus, the side portions of the edge 162 of the insert 158 are shown by phantom line 162 on top panel 114 spaced inside fold lines 116 and 120. Thus, the insert 158 is constructed so that it is not as wide as top panel 114. In addition, insert apertures 160A and B are made slightly larger than handle apertures 150A and B as shown by comparing the phantom lines 168A and B of the cut lines 166A and B of the insert apertures 160A and B with the handle aperture cut lines 164A and B.

This carton sleeve is loaded with bottles and closed in the same manner as the carton sleeve formed from blank illustrated in FIG. 1. The blank illustrated in FIG. 4 is designed to carry 20 bottles in a four by five configuration.

The carton sleeve is loaded with bottles and closed by gluing the end flaps together on both ends of the carton. Using one end as an example, side end flaps 130 and 142 are folded inwardly and top end flap 138 and bottom end flap 146 are folded and glued to side end flaps 130 and 142. Apertures 184 along fold lines 182A and B facilitate the folding of fold lines 182A and B of the insert 158 without the bunching of the paperboard. It is preferred that these end flaps be closed and secured in position by gluing, but other methods such as stapling may be used.

Figure 5:
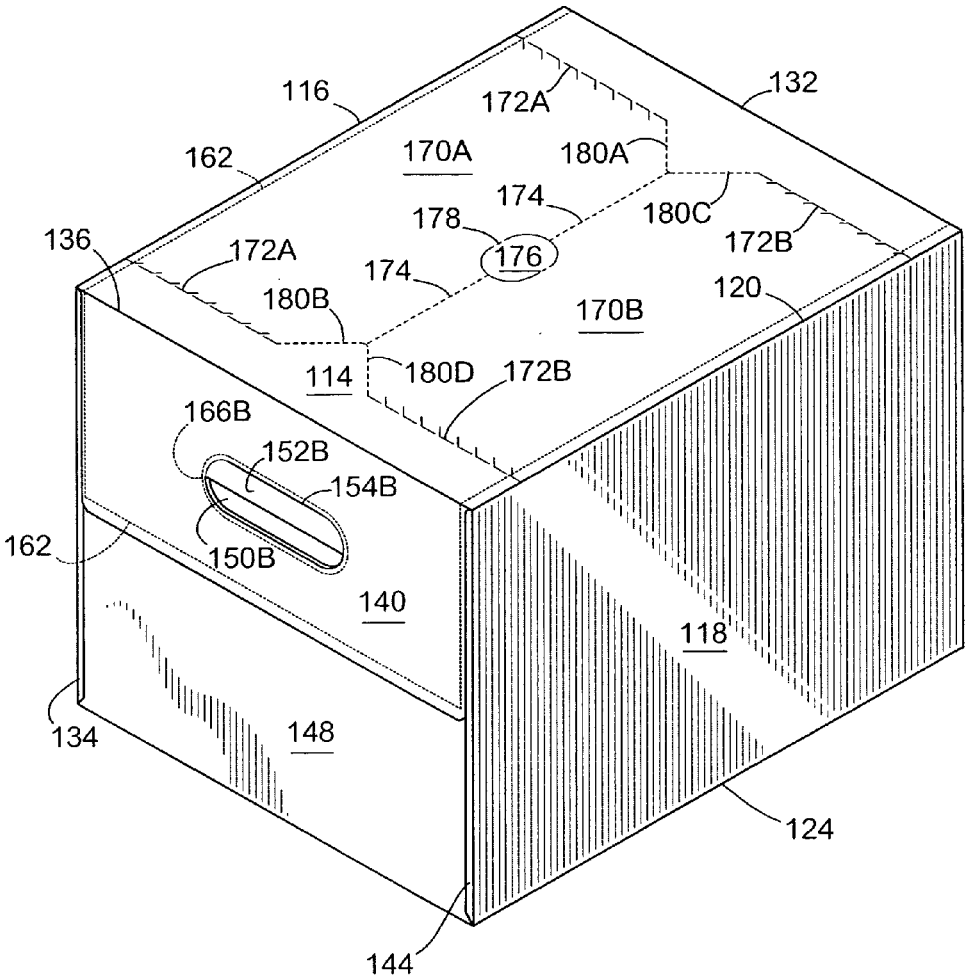
FIG. 5 is a perspective view of a carton made from the blank and paperboard insert shown in FIG. 4 loaded with bottles showing the tear lines for forming twin dispenser flaps.

After the carton made from the blank of FIG. 4 and is filled with bottles as illustrated in FIG. 5 it may be carried in the same way as the carton illustrated in FIG. 2. A person's hands are inserted through handle apertures 150A and B and insert apertures 160A and B and apertures 156A–D for carrying.

It is preferred that this carton has two handles, but it could be constructed as a carton with only one handle as some people like to carry this carton by one hand.

Figure 6:
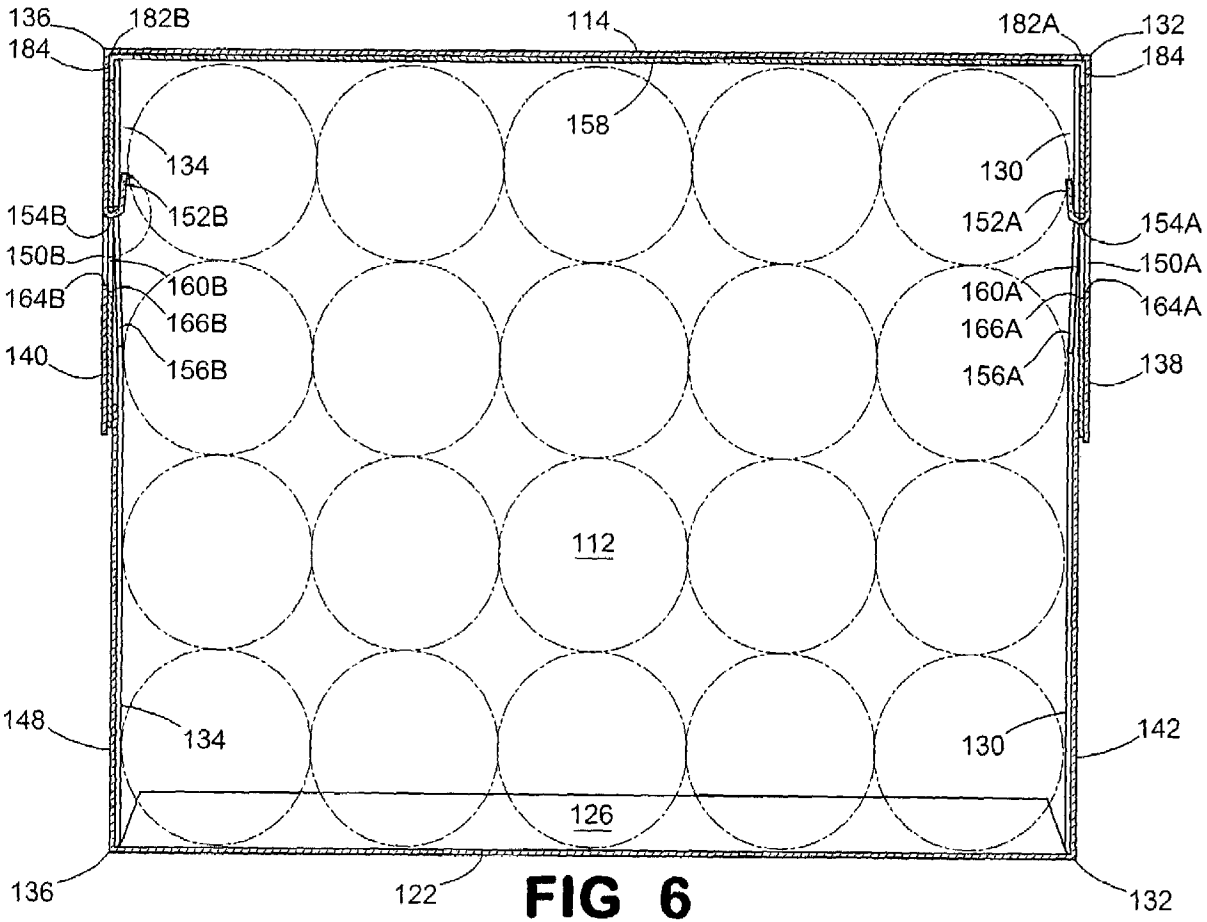
FIG. 6 is a longitudinal cross-section of the carton of FIG. 5 showing the paperboard insert which reinforces the top panel and carrying handle apertures in the top end flaps.

FIG. 6 is a longitudinal cross-section of FIG. 5 illustrating how the insert 158 forms a bridge along the top panel 114 of the carton to aid in reinforcing the handle apertures 150A and B and the top panel 114 of the carton. In looking at one end of the cross-section illustrated in FIG. 6, it will be noted that there four layers of paperboard protecting handle aperture 150A. The four layers consist of the top end flap 138, the insert 158 and side end flap 130, and handle flap 152A.

Figure 7:
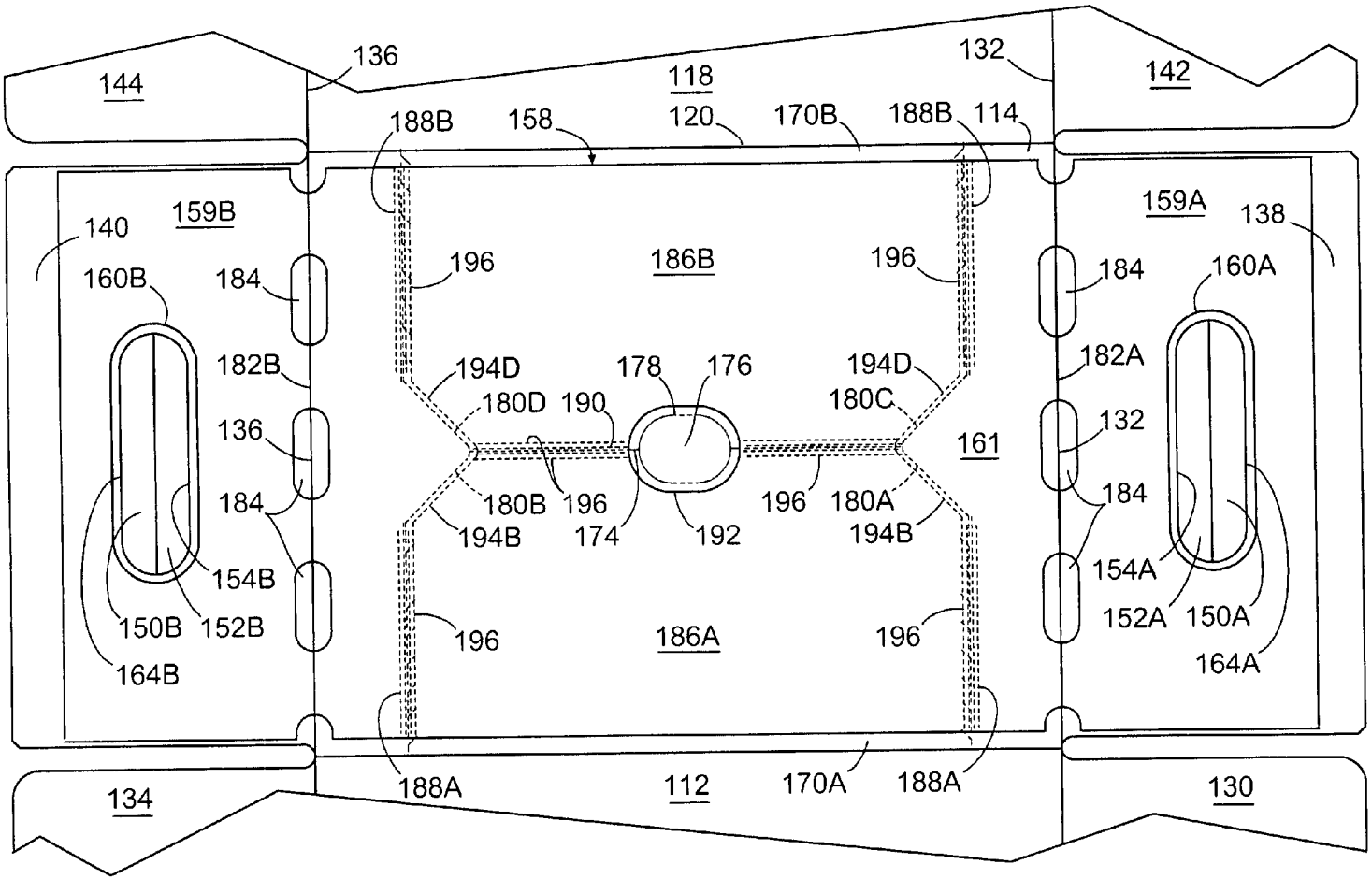
FIG. 7 is an enlarged fragmentary detail inside view of the top panel and top end flaps shown in FIG. 4 with the paperboard insert placed in proper position on this panel and the flaps.

The carton illustrated in FIG. 5 has twin dispensers which are formed when dispenser flaps 170A and B are opened. Either dispenser flap 170A or B may be opened by a person pushing in finger flap 176 into finger aperture 192 in the insert 158. It is important that there be a finger aperture 192 in the insert 158 as otherwise it would be very difficult to push in two layers of paperboard. Since flaps 186A and B are glued to dispenser flaps 170A and B, respectively, it is necessary to open two glued flaps to have access to the bottles in the carton. Because of some imprecision that may occur in the alignment of the insert 158 in relation to top panel 114, inside subsidiary tear lines 196 may be located for flaps 186A and B as best shown in FIG. 7. These inside subsidiary tear lines 196 are located inside tear lines 172A and B in the top panel 114 and on both sides of common tear line 174. It is preferred to have these subsidiary tear lines 196 located on both sides of the common tear line 190 in the insert so that any misalignment with the common tear line 190 in the insert 158 in relation to the common tear line 174 in the top panel 114 will not prevent either dispenser flap 170A and B from being opened. These inside subsidiary tear lines 196 can be located as necessary to aid in opening the dispenser flaps 170A and B. It is preferred to have these subsidiary tear lines 196 on both sides of common tear line 190 (in the insert 158) which is perpendicular to the ends of the carton. It is also preferred that the inside tear lines 196 be located parallel to the ends of the carton and inside of tear lines 188A and B in the insert 158.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. A paperboard carton with two ends for carrying a plurality of containers, the carton comprising:

(a) a bottom panel, top panel and adjoining side panels attached to the top panel by fold lines, with each end of the carton being closed by a top end flap attached to the top panel by a fold line, a side end flap foldably attached to each side panel, a bottom end flap foldably attached to the bottom panel, with means for securing said flaps on each end of the carton in the closed position;

(b) said carton having a handle aperture in at least one top end flap for carrying the carton when loaded with containers with said flaps being secured in the closed position, with each side end flap on the same end of the carton as said top end flap having an aperture which is sufficiently aligned with the handle aperture in said top end flap so that a person's hand can be extended through the handle aperture in said top end flap and aligned apertures in side end flaps for carrying the loaded carton; and (c) said carton having a paperboard insert which is secured by securing means to at least one of the (I) top end flaps and (ii) the side end flaps on each end of the carton having a handle aperture in said top end flap, said insert having an aperture that is sufficiently aligned with the handle aperture in said top end flap and apertures in said side end flaps so that a person's hand can be inserted through all aligned apertures to carry the carton when loaded with containers with both ends of the carton being secured in the closed position, said paperboard insert and said side end flaps reinforcing the top end flap with a handle aperture to preserve the integrity of said handle aperture when the carton is loaded with containers and being carried by a handle aperture in at least one of the top end flaps.

2. The carton of claim 1 which has a handle aperture in each top end flap.

3. The carton of claim 1 in which the means for securing the insert to the carton and the flaps together is glue.

4. The carton of claim 1 in which an insert is secured by securing means to each side end flap on each end of the carton having a handle aperture in said top end flap.

5. The carton of claim 1 in which a paperboard insert is secured by securing means to each top end flap having a handle aperture in said top end flap.

6. The carton of claim 5 in which each top end flap has a handle aperture and a separate paperboard insert is secured to each top end flap by securing means.

7. The carton of claim 6 in which each top end flap has an inside and outside surface and the paperboard inserts are secured to the inside surfaces of the top end flaps.

8. The carton of claim 7 in which each insert has an aperture larger than the corresponding handle aperture in the top end flap to which the insert is secured.

9. The carton of claim 8 which has interconnected tear lines in the top panel which extend into at least one side panel to form a dispenser flap which when torn open allows the removal of containers from the carton.

10. The carton of claim 9 in which the interconnected tear lines extend into each side panel and are interconnected in said top panel to form two dispenser flaps.

11. The carton of claim 10 in which a finger flap is formed by a tear line adjacent to a location in the interconnected tear lines that forms two flaps so that when the finger flap is opened the interconnected tear lines can be torn opening either or both dispenser flaps so containers can be removed from the carton.

12. The carton of claim 5 in which the insert also extends across the top panel from one top end flap to the other top end flap.

13. The carton of claim 12 in which the insert has apertures larger than the corresponding handle aperture in each top end flap.

14. The carton of claim 13 in which the insert has a fold line that is adjacent to the fold line between the top panel and each top end flap with each fold line in said insert being interspersed with a plurality of apertures along the fold line to facilitate closing and securing the top end flaps on each end of the carton together.

15. The carton of claim 14 in which each top end flap and the top panel has an inside and outside surface and the insert is secured to the inside surfaces of the top panel and the top end flaps by glue.

16. The carton of claim 15 which has interconnected tear lines in the top panel for forming at least one dispenser flap for removing containers from the carton when the flap is opened with the insert having corresponding interconnected tear lines that are located adjacent the interconnected tear lines in the top panel for forming an adjacent flap that can be opened with the dispenser flap in the top panel.

17. The carton of claim 14 which has interconnected tear lines in the top panel for forming two dispenser flaps for removing containers from the carton when a dispenser flap is opened with the insert having corresponding interconnected tear lines that are located adjacent to the interconnected tear lines in the top panel for forming flaps which are adjacent to the dispenser flaps in the top panel, with the adjacent flap in the insert opening when a dispenser flap in the top panel is opened.

18. The carton of claim 17 which has a finger flap formed by a tear line in the top panel adjacent the interconnected tear lines and a corresponding opening in the insert that is at least as large as the finger flap in the top panel.

19. The carton of claim 18 in which the insert has a plurality of subsidiary tear lines parallel to at least a substantial portion of the interconnected tear lines in the insert so that the combination of the interconnected tear lines and subsidiary tear lines are located in relation to the dispenser flaps in the top panel so as not to impede the opening of a flap in the insert when the adjacent dispenser flap in the top panel is opened.

20. The carton of claim 18 in which the insert has a plurality of subsidiary tear lines located parallel to a substantial portion of the interconnected tear lines in the insert so as to permit the tearing of the flap in the insert so that it is capable of being torn open and extended inside the opening formed by tearing and opening the adjacent dispenser flap in the top panel, said subsidiary tear lines being located so as to compensate for any slight misalignment when the insert is located and secured to the top panel.

21. A paperboard carton with two ends for carrying a plurality of containers, the carton comprising:

(a) a bottom panel, top panel and adjoining side panels attached to the top panel by fold lines, each end of the carton being closed by a top end flap attached to the top panel by a fold line, a side end flap foldably attached to each side panel, a bottom end flap foldably attached to the bottom panel with means for securing said flaps on each end of the carton in the closed position;

(b) said carton having a handle aperture in at least one top end flap for carrying the carton when loaded with containers with said flaps being secured in the closed position, with each side end flap on the same end of the carton as said top end flap having an aperture which is sufficiently aligned with the handle aperture in said top end flap so that a person's hand can be extended through the handle aperture in said top end flap and aligned apertures in said side end flaps; and (c) said carton having a paperboard insert which is secured by securing means to the top panel and at least one top end flap, said insert having an aperture that is sufficiently aligned with any handle aperture in a top end flap and apertures in the side end flaps on the same end of the carton so that a person's hand can be inserted through all aligned apertures to carry the carton when loaded with containers with both ends of the carton being secured in the closed position, said paperboard insert and said side end flaps reinforcing the top end flap with a handle aperture to preserve the integrity of said handle aperture when the carton loaded with containers is being carried by a handle aperture in at least one of the top end flaps.

22. The carton of claim 21 which has a handle aperture in each top end flap.

23. The carton of claim 22 in which the top end flaps and top panel have an inside and outside surface with the insert being secured to the inside surface of the top panel and the top end flaps.

24. The carton of claim 23 in which each aperture in the insert is slightly larger than the handle aperture in the top end flap on the same end of the carton in order to compensate for any imprecision in the alignment of the insert when being located and secured to the top panel and top end flaps.

25. The carton of claim 24 in which the means for securing the insert to the top panel and top end flaps and the means for securing the flaps on each end of the carton together is glue.

26. The carton of claim 25 in which the insert has a fold line that is adjacent to the fold line between the top panel and each top end flap, with each fold line in said insert being interspersed with a plurality of apertures along the fold line to facilitate closing the top end flaps and gluing the flaps on each end of the carton together.

27. The carton of claim 25 in which the top panel has tear lines for forming at least one dispenser flap with the insert having adjacent tear lines for forming a flap adjacent to the dispenser flap in the top panel so that when the dispenser flap and adjacent flap in the insert are opened an opening is formed for removing containers from the carton.

28. The carton of claim 27 in which there is a plurality of subsidiary tear lines parallel to and spaced close to said corresponding tear lines in the insert and located along a substantial portion of said tear lines, said tear lines and subsidiary tear lines being spaced and located so that the adjacent flap in the insert can be opened along with the dispenser flap in the top panel with the flap in the insert opening into the opening formed by opening the dispenser flap in the top panel, said tear lines and subsidiary tear lines permitting the dispenser flap and adjacent flap in the insert to be easily opened even though the insert has been secured to the top panel in a slightly imprecise location.

29. The carton of claim 28 in which a finger flap is formed in the top panel adjacent the tear lines forming the dispenser flap, said finger flap being formed by a tear line, said insert having an aperture in a location corresponding to the finger flap, said aperture being slightly larger than the finger flap so that any slight imprecision in securing the insert to the top panel does not interfere with a person's finger pushing the finger flap into the aperture in the insert to commence opening the dispenser flap and adjacent flap in the insert.

30. The carton of claim 28 which has twin dispenser flaps in the top panel in which a portion of the tear lines forming each flap is shared in common with a portion of the tear lines forming the other dispenser flap and the insert has twin flaps adjacent to the twin dispenser flaps in the top panel, with a portion of the tear lines forming each flap in the insert being shared with a portion of the tear lines forming the other flap in the insert.

31. The carton of claim 30 in which at least a substantial portion of the tear lines forming each flap in the insert that is shared in common with the tear lines forming the other flap in the insert has subsidiary tear lines parallel to and spaced close to said tear lines to facilitate the easy opening of either dispenser flap and adjacent flap in the insert.

32. The carton of claim 31 in which the portion of the tear lines in the top panel shared in common, and the portion of the tear lines in the insert shared in common are at least substantially perpendicular to each end of the carton.

33. The carton of claim 32 in which the finger flap in the top panel is adjacent the portion of the tear lines shared in common.

34. A paperboard carton with two ends for carrying a plurality of containers, the carton comprising:

(a) a bottom panel, top panel and adjoining side panels attached to the top panel by fold lines, each end of the carton being closed by a top end flap attached to the top panel by a fold line, a side end flap foldably attached to each side panel, a bottom end flap foldably attached to the bottom panel, said flaps being secured together in the closed position by glue;

(b) said carton having a handle aperture in each top end flap for carrying the carton when loaded with containers with said flaps being secured in the closed position, with each side end flap on the same end of the carton as said top end flap having an aperture which is sufficiently aligned with the handle aperture in said top end flap so that a person's hand can be extended through the handle aperture in said top end flap and aligned apertures in said side end flaps; and (c) said top panel and top end flaps having an inside and outside surface, said carton having a paperboard insert which is secured to the inside surface of the top panel and each top end panel by glue, said insert having an aperture that is adjacent to, but is slightly larger than the handle aperture in each top end flap, said insert having a fold line that is adjacent to the fold line between the top panel and each top end flap, with each fold line in said insert being interspersed with a plurality of apertures along the fold line to facilitate closing the top end flaps and gluing the flaps on each end of the carton together; and (d) said top panel having twin dispenser flaps formed by a common tear line with two ends which is at least substantially perpendicular to the top end flaps, with a finger flap formed by a tear line along said common tear line, with each dispenser flap being defined by a tear line near each top end flap that extends from an end of the common tear line diagonally for a distance towards the nearest end flap and then turns towards the nearest side panel, with the fold line between the side panel and top panel forming a hinge to facilitate opening the dispenser flap, said insert having corresponding tear lines and an aperture aligned with the finger flap in the top panel but slightly larger in size.

35. The carton of claim 34 in which the corresponding common tear line in the insert has subsidiary parallel tear lines spaced close to the common tear line and each corresponding tear line in the insert that extends towards a side panel has subsidiary parallel tear lines, said subsidiary tear lines in the insert facilitating the opening of each flap in the insert when the adjacent dispenser flap is being opened by compensating for any imprecision in locating and securing the insert to the top panel.

* * * * *